US012332022B2

(12) United States Patent
Cutrer

(10) Patent No.: US 12,332,022 B2
(45) Date of Patent: Jun. 17, 2025

(54) OPTICS MOUNT AND RISER SYSTEM FOR A FIREARM

(71) Applicant: Slade Cutrer, Grant Pass, OR (US)

(72) Inventor: Slade Cutrer, Grant Pass, OR (US)

( * ) Notice: Subject to any disclaimer, the term of this patent is extended or adjusted under 35 U.S.C. 154(b) by 0 days.

(21) Appl. No.: 18/441,821

(22) Filed: Feb. 14, 2024

(65) Prior Publication Data

US 2024/0271912 A1 Aug. 15, 2024

Related U.S. Application Data

(60) Provisional application No. 63/470,387, filed on Jun. 1, 2023, provisional application No. 63/445,520, filed on Feb. 14, 2023.

(51) Int. Cl.
*F41G 11/00* (2006.01)

(52) U.S. Cl.
CPC ..... *F41G 11/003* (2013.01)

(58) Field of Classification Search
CPC ..... F41G 11/003; F41G 11/001; F41G 11/004
See application file for complete search history.

(56) References Cited

U.S. PATENT DOCUMENTS

| | | | | |
|---|---|---|---|---|
| D824,481 | S * | 7/2018 | Geissele | D22/110 |
| 11,733,004 | B2 | 8/2023 | Fackler et al. | |
| 12,123,682 | B2 | 10/2024 | Fackler et al. | |
| D1,050,856 | S * | 11/2024 | Fackler | D22/108 |
| 2018/0135946 | A1* | 5/2018 | Geissele | F41G 11/003 |
| 2019/0277605 | A1* | 9/2019 | Geissele | F41G 11/003 |
| 2020/0025522 | A1* | 1/2020 | Zimmer | F41G 11/003 |
| 2023/0135474 | A1* | 5/2023 | Fackler | F41G 11/007 42/111 |
| 2023/0168068 | A1* | 6/2023 | Fackler | F41G 11/006 42/124 |

* cited by examiner

*Primary Examiner* — Joshua E Freeman
(74) *Attorney, Agent, or Firm* — Scott D. Smiley; Scott M. Garrett; The Concept Law Group, P.A.

(57) ABSTRACT

An optic mount modular system includes a bridge portion that is mounted on the top rail of a firearm. The bridge portion can have either an integral optics riser on which a sight can be mounted, or a top rail section. The bridge portion has a front end and a rear end, each of which have a vertical face in which there is a horizontal bore. At the top of the bridge portion at the front and rear ends there are horizontal interfaces or surfaces in which there are vertically oriented threaded bores. Accessories such as rail extension portions and magnifier mounts can be mounted to the bridge portion at the front and rear ends. These accessories can include an alignment pin or protrusion than extends from a vertical face that mates against the vertical face at the front end or rear end of the bridge portion, and the alignment pin or protrusion will fit into the horizontal bore of the front or rear end. The accessories also have a tongue that extends over the top of the bridge portion at the front end or rear end, and a threaded fastener passes through an opening in the tongue that is aligned with the vertical threaded bore in the bridge portion. A threaded fastener can then securely attach the accessory to the bridge portion.

20 Claims, 16 Drawing Sheets

OPTICS MOUNT AND RISER SYSTEM FOR A FIREARM

CROSS REFERENCE

This application claims the benefit of provisional application No. 63/445,520, filed Feb. 14, 2023, and provisional application No. 63/470,387, filed Jun. 1, 2023, the entireties of each of which are hereby incorporated by reference.

FIELD OF THE INVENTION

The present invention relates generally to optics mounts for a firearm, particularly are rifle having an existing rail on the receiver, and, more particularly, relates to an optic mount and riser system that allows placement of an electronic sight above the rail provided on the receiver, as well as elevated rail portions before and after the electronic sight for additional optics and sighting accessories.

BACKGROUND OF THE INVENTION

A rifle must have a means for aiming the rifle in order to effectively engage a target. Older aiming systems used two sights; a front sight and a rear sight that the operator would align in their view over the target. Although effective for aimed shooting, it is less than ideal for certain target engagement applications. For example, in close quarters combat engagements, it is not always practical to fully shoulder a rifle and for the operator to hold the rifle up, and their head in position to maintain alignment of the front and rear sights.

To alleviate awkward shooting positions in close quarters engagements, reflex and so called "red dot" sights have been developed that do not require the operator to hold the rifle up to align sights. A red dot sight is essentially a reflex sight in a tube or other elongated structure. There are many variations on these types of sights, and for the sake of convenience they will all be referred to as "red dot" sights herein, even though many will produce other color dots (e.g. green) and have different ways of producing the dot or other targeting reticle. In general, they are non-magnified laser reflection sights that produce a central dot or other reticle in the center of the view through the sight. However, unlike "iron" sights, the dot or reticle shifts as the operator moves their head away from being centrally aligned with the sight. As a result, the operator can effectively aim the rifle without having to align their view parallel to the barrel of the right. As the dot or reticle appears in their view over the target the rifle will be effectively aimed. This allows for more practical positioning of the rifle and much faster target acquisition compared to iron sights, which is a tremendous advantage in many types of engagement applications.

Although a red dot sight does not require the operator to align their view perfectly through the red dot sight in order to effectively aim the rifle, there are limits as to how far off center the operator can position their head. For example, on an AR-15 type right, the top of the stock is about even with the top rail of the upper receiver. If a red dot sight is mounted directly on the rail, the operator would have to press their head into the stock in order to maintain the red dot in the red dot sight in their field of view. Accordingly, it is very common to mount the red dot sight on a riser that elevates the red dot sight over the top of the receiver, allowing the operator a more comfortable and practical head and body position in using the red dot sight for target acquisition.

Although risers move the red dot sight into a more practical position compared to being mounted directly on the receiver, red dot sights are often used in conjunction with other optics and sighting/aiming accessories. For example, it is not uncommon for an operator to also mount a magnifier in front of the red dot sight (e.g. between the red dot sight and the operator). Often a magnifier is mounted on a "flip to the side' type of mount that allows the operator to selectively position the magnifier in line with the red dot sight, or to flip it to the side so that the red dot sight can be used without magnification. But in order to align a magnifier with a red dot sight that is mounted on a riser, the magnifier will also need to be mounted on a riser.

Therefore, a need exists to overcome the problems with the prior art as discussed above.

SUMMARY

In accordance with some embodiments of the inventive disclosure, there is provided an optics riser for a rifle that includes a bridge portion having a front end and a rear end. At one of the front end or the rear end there is a vertical face into which is formed a horizontal bore. There is also a top surface at the end in which there is a vertical bore that is threaded. There is also at least one clamp member that is configured to clamp to a rail on a top of a firearm.

In accordance with a further feature, a top of the bridge portion includes a rail section.

In accordance with a further feature, a top of the bridge portion includes an integral riser stem having a top.

In accordance with a further feature, the top of the riser stem includes an optics bed.

In accordance with a further feature, the at least one clamp member comprises a front clamp member and a rear clamp member.

In accordance with some embodiments of the inventive disclosure, there is provided a riser system for mounting on a top rail of a firearm that includes a bridge portion having a front end and a rear end, and a top that extends from the front end to the rear end. The front end has a vertical face defining a plane that is perpendicular to an elongated direction of the bridge portion, and into which a horizontal bore extends. There is at least one clamp at a side of the bridge portion that is configured to clamp to the rail of the firearm. There is also at least one accessory that mounts to the front end using an alignment pin that fits into the horizontal bore, and which is not attached to the rail of the firearm.

In accordance with a further feature, the top of the bridge portion comprises a riser stem that extends vertically upward from the top of the bridge portion.

In accordance with a further feature, a top of the riser stem comprises an optics bed.

In accordance with a further feature, the top of the bridge portion comprises a rail section.

In accordance with a further feature, the accessory is a rail extension portion and a top of the accessory comprises a rail section that is co-level with the rail section of the bridge portion.

In accordance with a further feature, the vertical face of the front end further includes a threaded bore, and the accessory further includes a threaded fastener that passes through an opening in the accessory and into the threaded bore.

In accordance with a further feature, a top of the bridge portion at the front end has a vertical bore that is threaded into the bridge portion, and the accessory includes a tongue that extends over the top of the bridge portion at front end of the bridge portion, the tongue having an opening through it that corresponds to the vertical bore, and a threaded fastener passing through the opening in the tongue and into the vertical bore.

In accordance with a further feature, the top of the bridge portion includes a rail section, and top of the accessory includes a rail portion that is co-level with the rail second on the top of the bridge portion.

In accordance with a further feature, the at least one clamp member comprises a front clamp member and a rear clamp member.

Although the invention is illustrated and described herein as embodied in an optics mount and rail system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
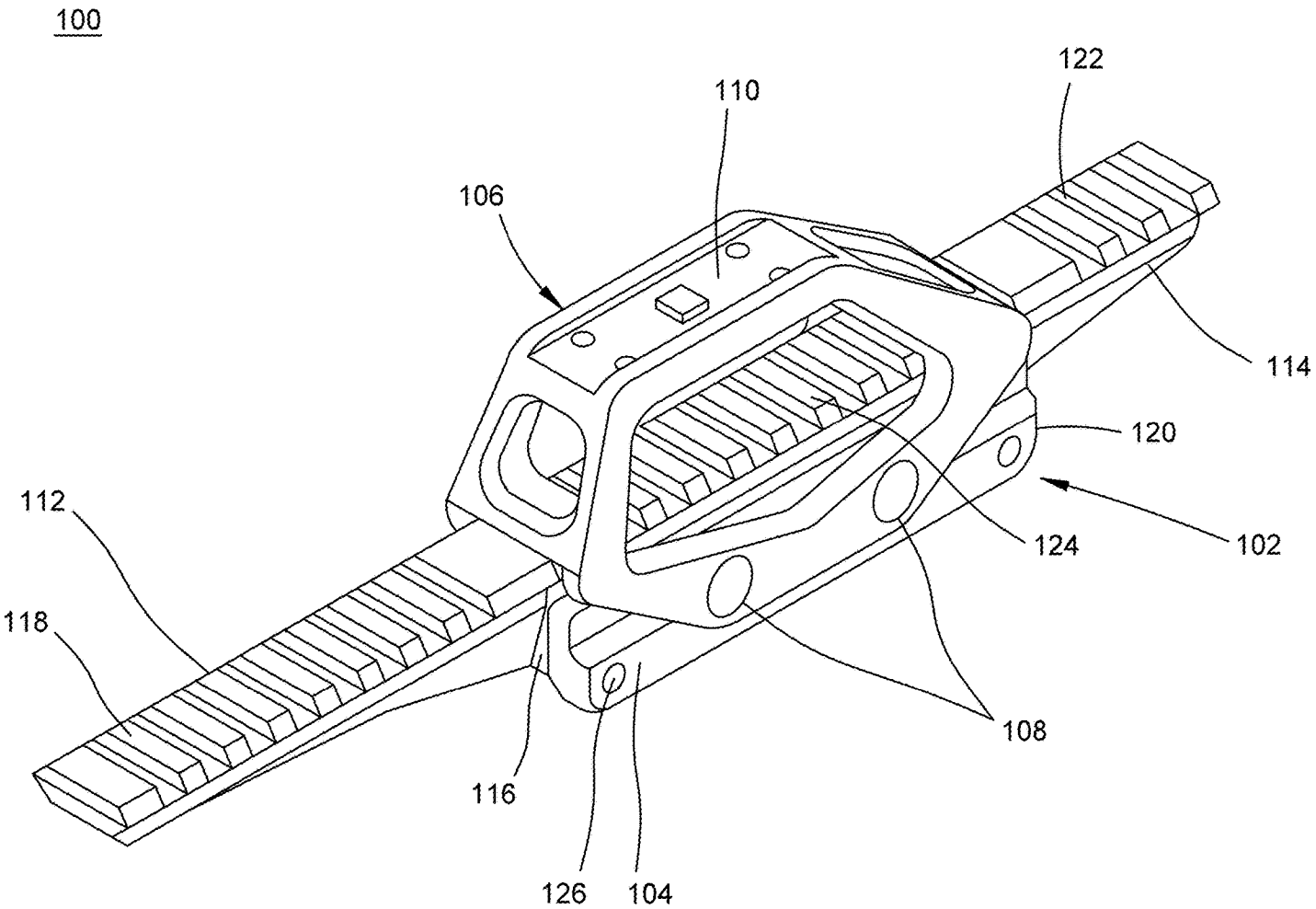
FIG. 1 is a perspective view of an optics mount and riser system, in accordance with some embodiments, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms. Following the claims section there is an appendix that provides images of the disclosed rail riser system and applications of the rail riser system. This is not meant to be an exhaustive listing of all possible arrangements, rather some examples to show the wide variety of configurations that are possible with the disclosed rail riser system.

FIG. 1 is a perspective view of an optics mount and riser system 100, in accordance with some embodiments. The same system 100 or portions thereof are shown in the drawings through FIG. 10B. The system 100 is designed to attach onto the receiver of a rifle, and in particular to a rail such as that known by the name Picatinny rail which is located on the top of the receiver of the rifle. The rail can be formed in compliance with the MIL-STD-1913 specification for an accessory mounting rail. Such a rail is common on, for example, the top of the upper receiver of an AR-15 pattern rifle. The AR-15 pattern rifle is used in both military and civilian rifle versions. The rail consists of a strip undercut to form a "flattened T" with a hexagonal top cross-section, with cross slots interspersed with flats that allow accessories to be slid into place from the end of the rail and then locked in place. It is similar in concept to the earlier commercial Weaver rail mount used to mount telescopic sights, but is taller and has wider slots at regular intervals along the length of the rail.

The system 100 includes a bridge portion 102 that engages and clamps to the rail on the top of the rifle receiver using features on the bottom of the bridge portion 102 that mesh with the features of the rail on the top of the rifle receiver, and the clamp 104 is tightened by threaded fasteners 126 that engage the undercut sides of the rail features on the rail of the firearm. The bridge portion 102 can be considered to be a base on which other parts of the system 100 can be attached to expand the system. The bridge portion 102 can support an optic riser 106 that straddles and attaches to the sides of the bridge portion 102 by fasteners 108, which can be bolts or screw type fasteners. At the top of the optic riser 106 is an optic bed 110 which is configured to receive the bottom of an optic, such as a red dot optic. The optic is an aiming device through which the operator looks, and a indicia, such as a red dot indicates at what the rifle is aimed. Thus, an operator moves the rifle until the indicia is on the target in order to engage the target. The optic bed 110 configuration can vary from one riser 106 to another so that the correct optic bed 110 can be used for a give optic. That is, different optics can have different bedding configurations on their bottom side, so different versions of the riser 106 with corresponding different optic beds 110 can be made to accommodate the variety of optics that are available. In some cases the operator may forego an optic used on a riser 106 and desire to attach another aiming device onto the top of the bridge portion 102, thus there is a rail section 124 provided on the top of the bridge portion 102. The rail section 124 can be used to mount, for example, a magnified optic such as a scope.

A front rail extension portion 112 can expand the system 100 from the bridge portion 102, and can be coupled to the front 116 of the bridge portion 102. The front 116 of the bridge portion 102 is generally flat and presents a vertical surface have a plane that is perpendicular to the elongated direction of the bridge portion 102 (i.e. from front to back), and is the end of the bridge portion 102 intended to be closest to the muzzle of the firearm in most applications (although the nature of the rail system is that it can be mounted in a reverse orientation as well). The front rail extension portion 112 provides additional rail space 118 on a top of the front rail portion 112 that can be co-level with the rail portion 124 on the top of the bridge portion. That is, the top of the bridge portion 106 (or base) is at the same height as the top of the front rail extension portion 112. The front rail portion 112 is attached only to the bridge portion 102, and is not attached to or mountable on the rail of the firearm. The rail portion 118 provides rail space on which other accessories can be mounted.

Likewise, a rear rail extension portion 114 can be coupled to the rear 120 of the bridge portion 102. The rear rail extension portion 114 has a rail section 122 on the top of the rear rail portion 114 that, when the rear rail portion 114 is mounted on the bridge portion 102, is co-level with the rail portion 124 on the top of the bridge portion 102. The rear rail extension portion 114 couples directly to the bridge portion 102 and is not capable of mounting on the rail of the firearm. The rear rail portion 114 can be used, for example, to mount a 'flip to the side' magnifier for use with a red dot optic mounted on the optic bed 110 of the optic riser 106.

Figure 2:
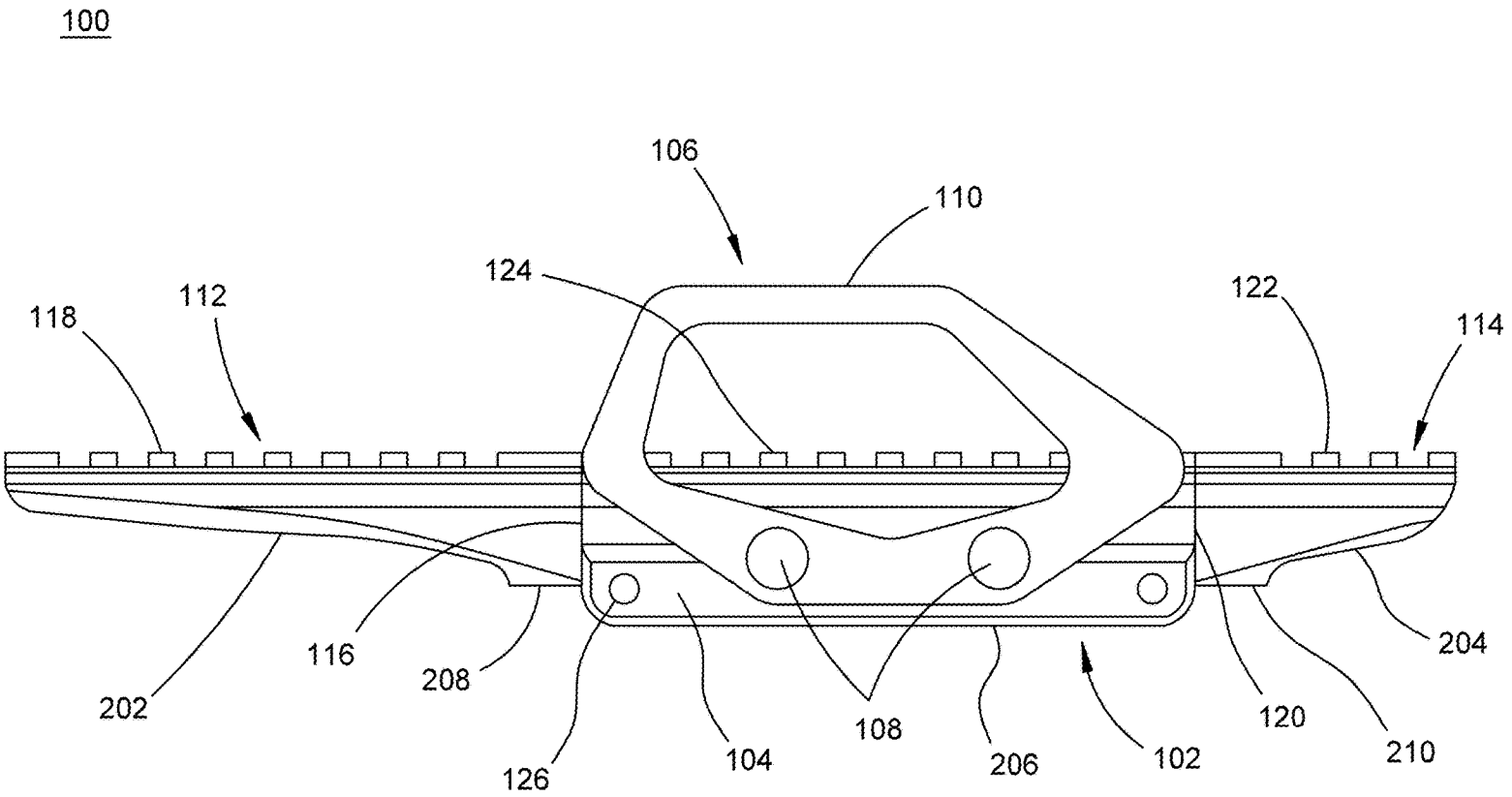
FIG. 2 is a side elevational view thereof, in accordance with some embodiments.
Figure 3:
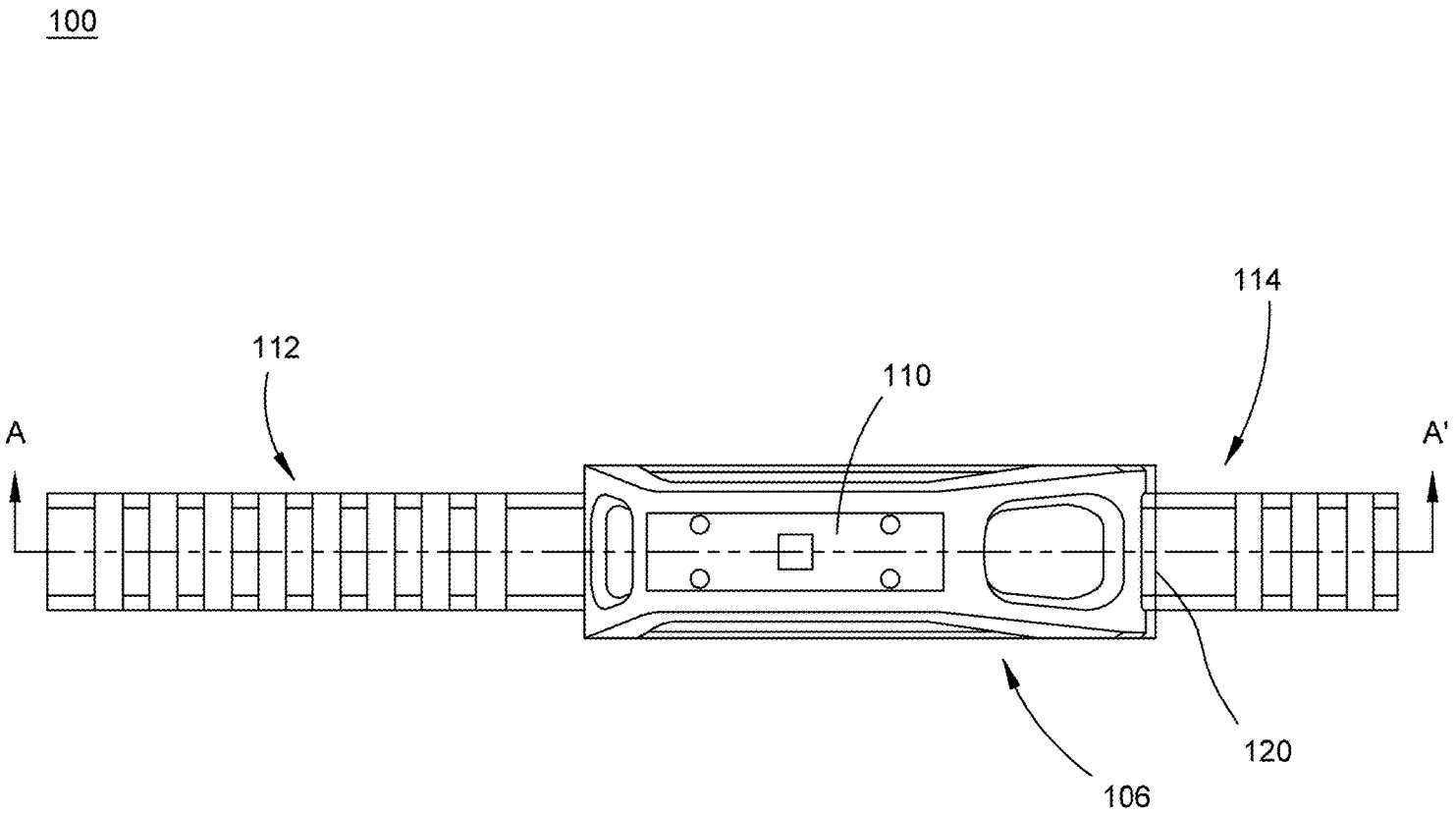
FIG. 3 is a top plan view thereof, in accordance with some embodiments.

In FIG. 2, which shows a side elevational view of the riser system 100, it can be seen that the rail portion 118 of the front rail extension portion 112, and the rail portion 122 of the rear rail extension portion 114, are co-level with the rail portion 124 of the bridge portion 102. It can also be seen that the bottom 206 of the clamp portion 104 extends down from the bottom 208 of the front rail extension portion 112, and the bottom 210 of the rear rail extension portion 114. In fact, the bottoms 208, 210 are the bottoms of bosses that each support a respective threaded fastener that passes horizontally through the front and rear rail extension portions 112, 114, respectively, into the bridge portion 102. The remainder of the undersides 202, 204 of the front and rear rail portions 112, 114, can slope upwards toward the distal ends in order to reduce the weight of the front and rear rail extension portions 112, 114. In FIG. 3, which shows a top plan view of the riser system 100, it can be seen that the optic riser 106 extends outward over the sides of the bridge portion, which is mostly out of view in this drawing. The line A-A' extends along the elongated direction through the system and indicate the section line for FIG. 4.

Figure 4:
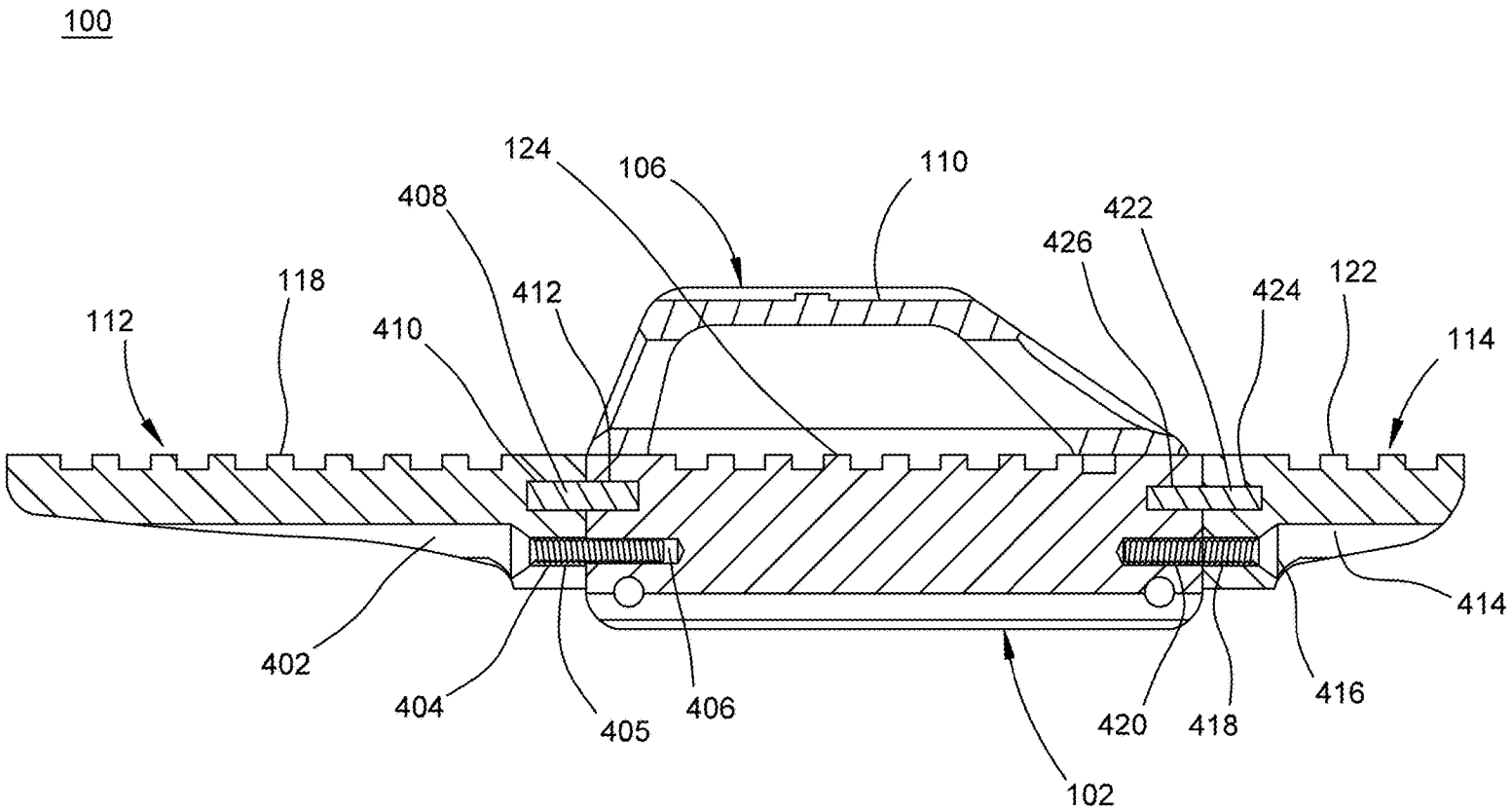
FIG. 4 is a side elevational cut-away view thereof, with the section taken along line A-A' in FIG. 3, in accordance with some embodiments.

FIG. 4 is a side elevational cut-away view of the riser system 100, with the section taken along line A-A' in FIG. 3. In this view it can be seen that the front and rear rail extension portions 112, 114 each have a fastener recess 402, 414 in them that allows a respective fastener 404, 416 to thread into a corresponding threaded hole/bore 406, 420 in the front and rear of the bridge portion 102. The fastener bores 405, 418 through the front and rear rail extension portions 112, 114 can be unthreaded, and the heads of the fasteners 404, 416 are thus drawn to bear against the corresponding region of the front and rear rail extension portions 112, 114 to tighten the front and rear rail extension portions 112, 114 against the front and rear, respectively, of the bridge portion 102. Because the front and rear rail extension portions 112, 114 are not coupled to the rail of the rifle, alignment pins 408, 422 are used at the front and rear of the bridge portion 102 to prevent the front and rail extension portions 112, 114 from turning about their respective fasteners 404, 416. The alignment pins 408, 422 each sit partially in a bore 410, 424 in the respective rail extension portions 112, 114 and partially in a corresponding bore 412, 426 in the front and rear, respectively, of the bridge portion 102. As can be seen here, the rail portions 118, 122 provided on the front and rear rail extension portions 112, 114 are at the same height as the rail portion 124 on the top of the bridge portion 102. Alternatively, instead of an alignment pin 408, 422 that sits in corresponding bores of the bridge portion 102 and the front and rear rail extension portions 112, 114, the same function can be equivalent accomplished by providing a protrusion on one portion and a bore that receives the protrusion on the mating portion, or vice versa.

Figure 5:
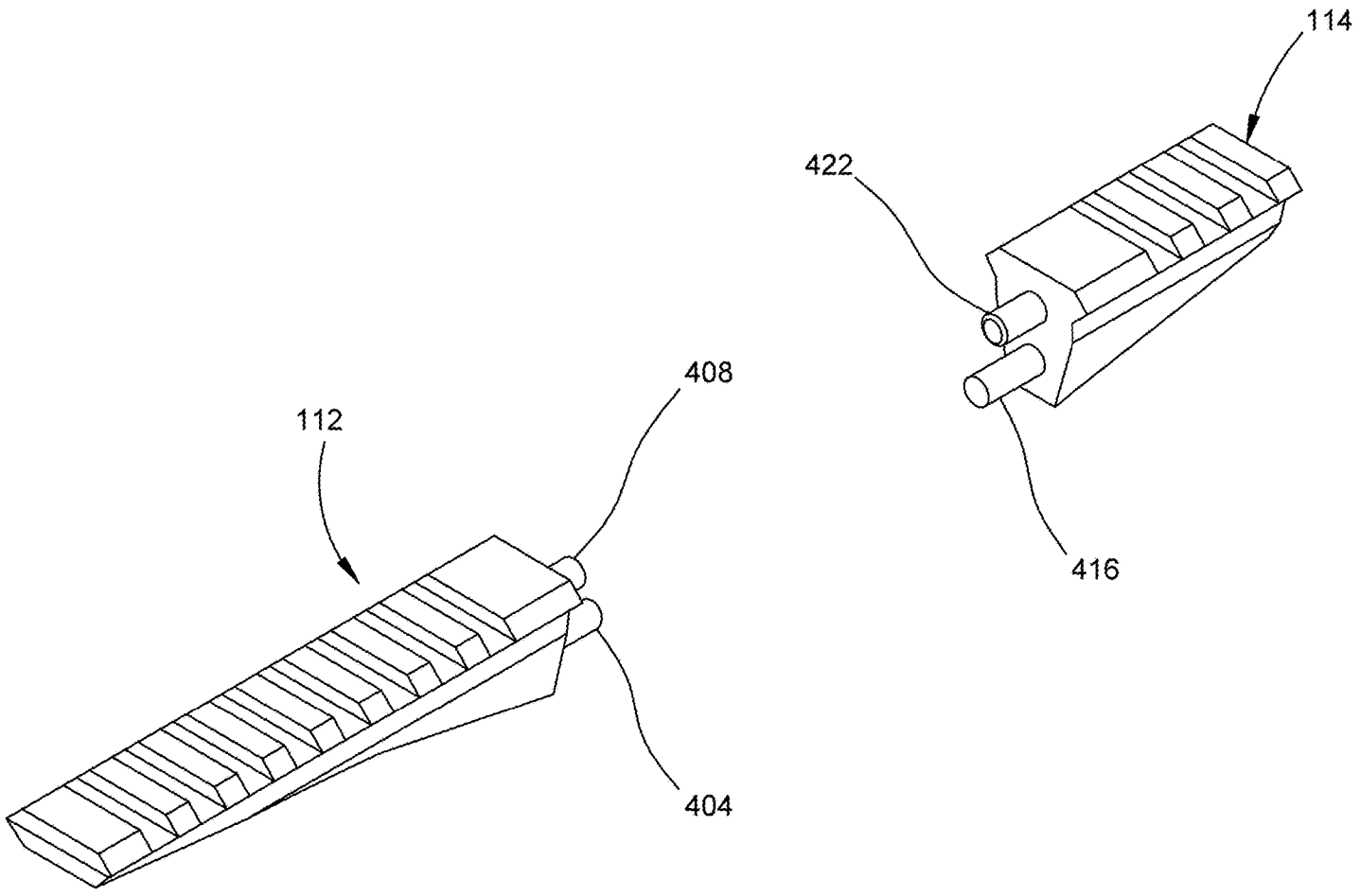
FIG. 5 is perspective view of the front and rear rail extension portions by themselves, in accordance with some embodiments.

FIG. 5 shows a perspective view of the front and rear rail extension portions 112, 114 by themselves, and the fasteners 404, 416 and alignment pins 408, 422 for each portion 112, 114 can be seen. To install a rail extension portion (front or rear), the alignment pin is first placed either in the bridge or the rail extension portion being coupled to the bridge, and then the rail extension portion is brought against the respective face of the bridge portion (front or rear) such that the alignment pin is partially in each of the rail extension portion and the bridge portion, and then the fastener 404, 416 threaded into place to fasten the rail extension portion 112, 114 to the bridge 102.

Figure 6:
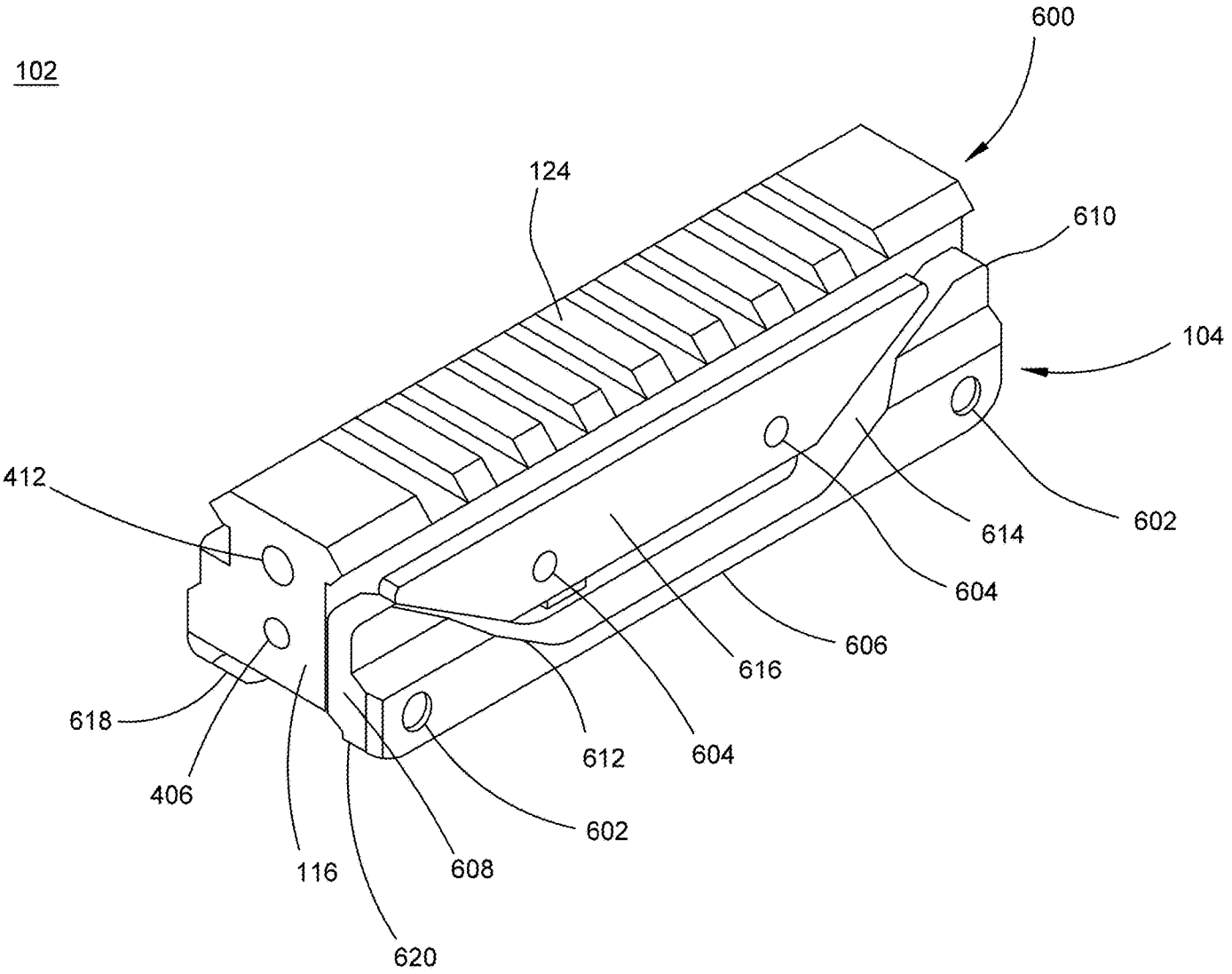
FIG. 6 is a perspective view of the bridge portion without the front or rear rail extension portions or the riser, in accordance with some embodiments.

FIG. 6 is a perspective view of the bridge portion 102 without the front or rear rail extension portions 112, 114 or the optic riser 106 in place on the bridge portion 102. The bridge portion 102 engages with the rail or rail portions on top of the rifle/firearm. Here, the clamp portion 104 can be seen as a separate part from the main body 600 of the bridge portion 102. There are openings 602 through which threaded fasteners (e.g. 126) attach the clamp portion 104 to the side of the main body 600 (in corresponding threaded bores). The clamp portion 104 includes a front end 608 and a rear end 610. At the front end 608 the top of the clamp portion 104 is adjacent the rail portion 124 on the top of the bridge portion 102, and has a downward slope 612 to a cross section 606 that connects the front end 608 to the rear end 610 of the clamp portion 104. Likewise, the top of the rear end 410 is adjacent the rail portion 124, and has a downward slope 614 to the cross portion 606. As a result, a side area 616 of the body 600 is exposed, and has two openings 604 for attaching the optic riser 106. The exposed side area 616 thus has a shape similar to an inverted trapezoid, and extends outward from the side of the body 600 at least as far as the outward-most point of the rail 124 to allow the optic riser 106 to fit over the rail 124 and be attached to the side area 616 and the corresponding side area on the opposite side of the body 600. At the bottom of the clamp portion 104, on the inside edge, is a rail engagement protrusion 620 that opposes a similar rail engagement protrusion 618 at the bottom of the opposite side of the body 600. The engagement protrusions 618, 620 fit under the outward extending tops of the rail on the top of the firearm such that when the clamp portion 104 is tightened towards the side of the body 600, as is well known.

Figure 7C:
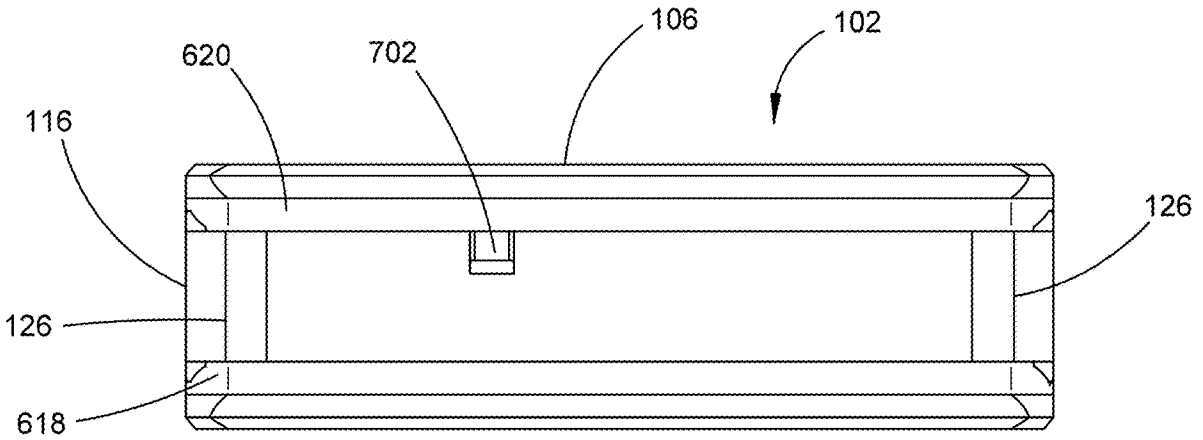
FIGS. 7A-7C shows end, side, and bottom views, respectively, of the bridge portion, in accordance with some embodiments.
Figure 7B:
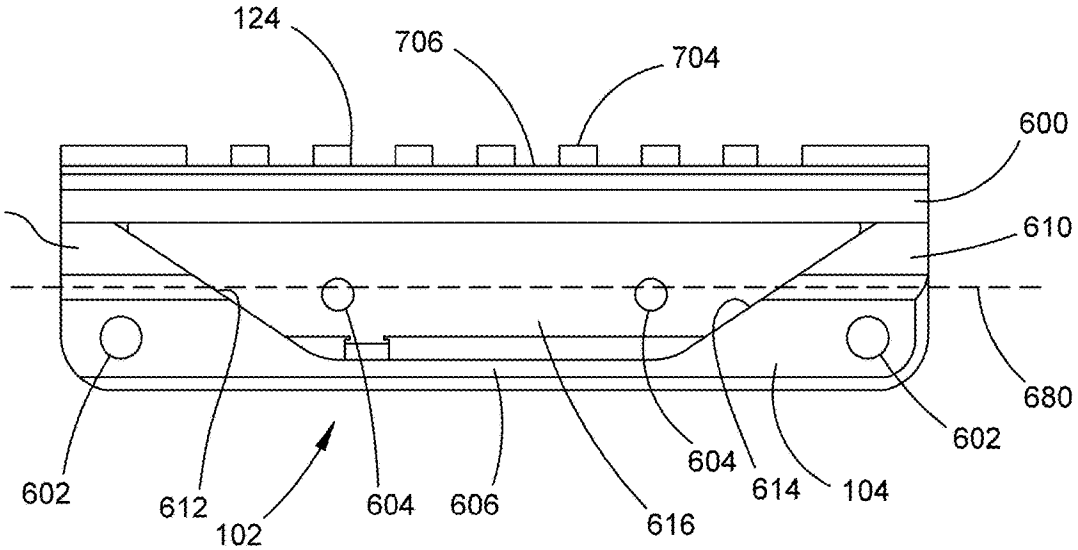
Figure 7A:
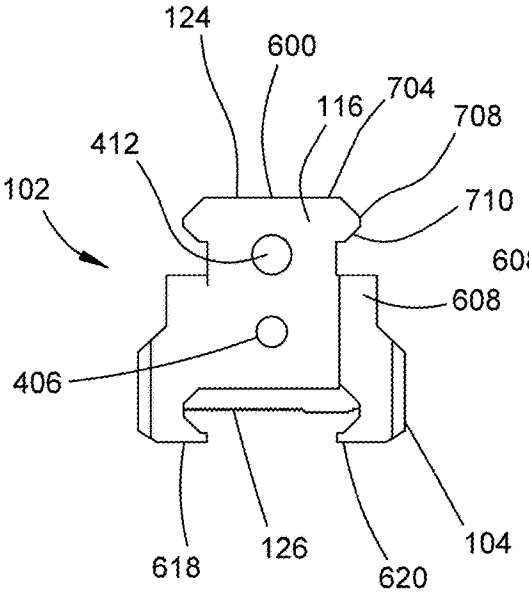

FIGS. 7A-7C show, respectively, a front-end elevational view, a left side elevational view, and a bottom plan view of the bridge portion 102. The bridge portion 102 has rail engagement section 702 on the bottom of the bridge portion that sits between adjacent raised sections of the rail and prevents the bridge portion 102 from sliding forward or backward when mounted on a rail. In addition, the engagement protrusions 618, 620 act to pull the bridge portion 102 downward when the clamp portion 104 is tightened due to the angle of engagement and the slope of the rail portions where the engagement protrusions 618, 620 make contact with the rail. The threaded fasteners 126 can be seen in FIGS. 7A and 7C which tighten the clamp portion 104 against the side of the body 600 of the bridge portion. These threaded fasteners 126 pass between rail segments into the body at the opposite side of the body from the clamp portion 104. In FIG. 7B the side view of the rail section 124 on the top of the bridge portion 102 can be seen to include a series of alternating raised sections 704 and spaces 706 between the raised sections 704. In FIG. 7A, the raised section 704 can be seen to have an outward-extending portion 708 that slopes down from the top to an outward peak, and then slopes back in again along the underside 710. The rail section 124 replicates the rail on the top of the firearm receiver, and rain engagement section 702 will sit in one of the spaces of that rail, which will be identical to space 706, and the engagement protrusions 618, 620 will bear against the underside of that rail, which is exactly like underside 710 on both sides of the rail. Line 680 indicates the elongated direction or longitudinal axis of the bridge portion 102.

Figure 8:
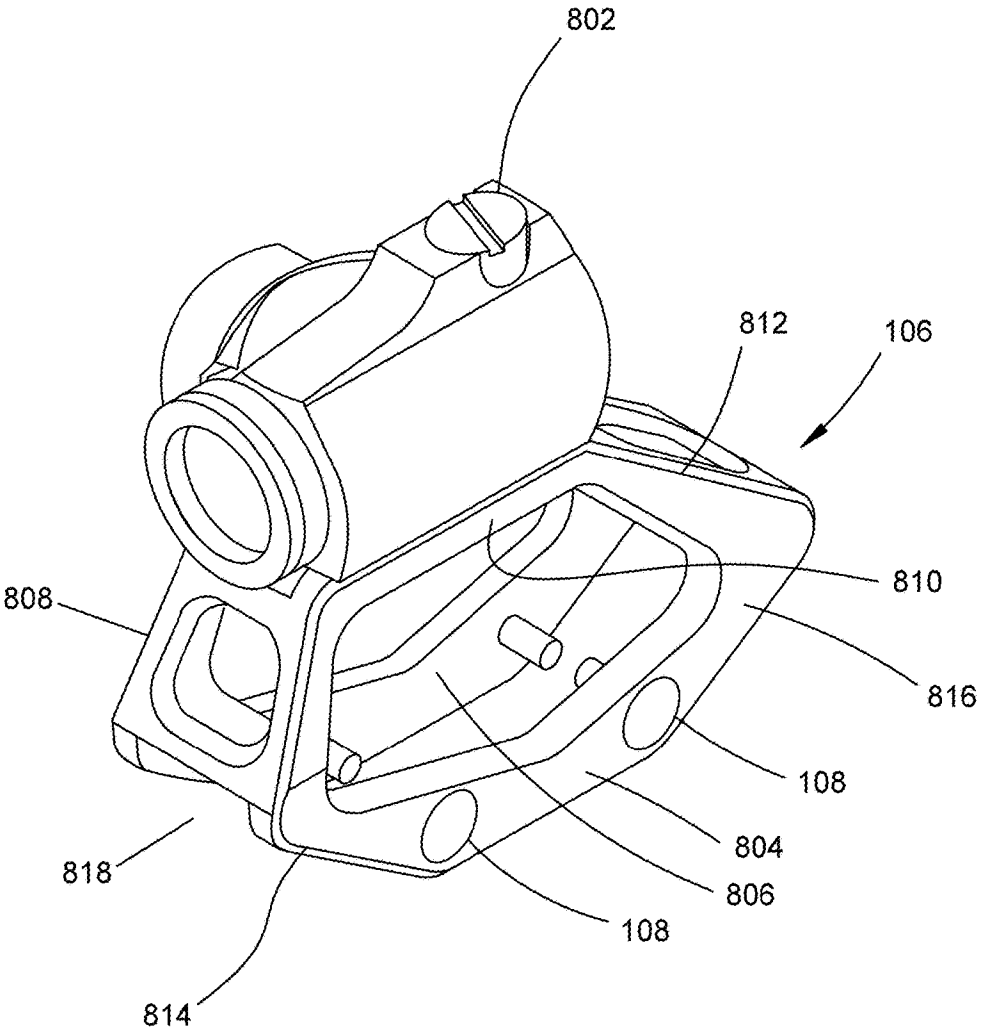
FIG. 8 is a perspective view of the riser by itself, in accordance with some embodiments.

FIG. 8 is a perspective view of the optic riser 106 with a red dot optic 802 mounted on the top of the optic riser 106 in the optic bed (e.g. 110). The optic riser is an optional portion of the system for mounting specific optics that fit in the optic bed, and can be used to mount a sight above the top of the rifle in a position that is much more ergonomic for certain engagement activity. The riser 106 has two side portions that fit over the rail 124 on the top of the bridge portion 102 and engage the sides (e.g. 616) of the bridge portion 102. The sides of the optic riser 106 include an upper section that rises above the rail 124 of the bridge portion 102, and a lower section that engages the sides areas (e.g. 616) of the bridge portion 102. At the bottom of each side of the riser 106 are connecting portion 804, 806 which connect a front lower leg 814 with the rear lower leg 816. The front lower leg follows the slope 612 of the front portion 608 of the clamp 104, and an identical structure on the opposite side of the body 600 of the bridge portion 102. Likewise, the rear lower leg follows the slope 614 of the rear portion 610 of the clamp 104, and the bottoms 804, 806 run along the top of the cross portion 606 of the clamp 104 and the corresponding structure on the opposite side of the body 600 (which does not move and is integral to the body 600). Fasteners 108 pass through the bottoms 804, 806 and engage threaded bores 604 in the sides of the body 600 to attach the riser 106 to the bridge portion 102. Accordingly, there is a space 818 between the lower leg portions on each side of the riser 106, and the width of the space is slightly more than the width of the rail 124. Thus, the width of the body 600 at the side area 616 through the body in a direction perpendicular to the plane of the side area 616 is also slightly greater than the width of the rail 124 (e.g. between opposing outward peaks of the outward-extending portion 708 of the raised sections 704 of the rail 124. The upper forward legs 808 and upper rearward legs 812 elevate the optic platform 810, which contains the optic bed 110, over the rail 124 of the bridge portion to a specified height above the top of the firearm, in a position that makes it easy for an operator holding the rifle to view through the optic 802.

Figure 9B:
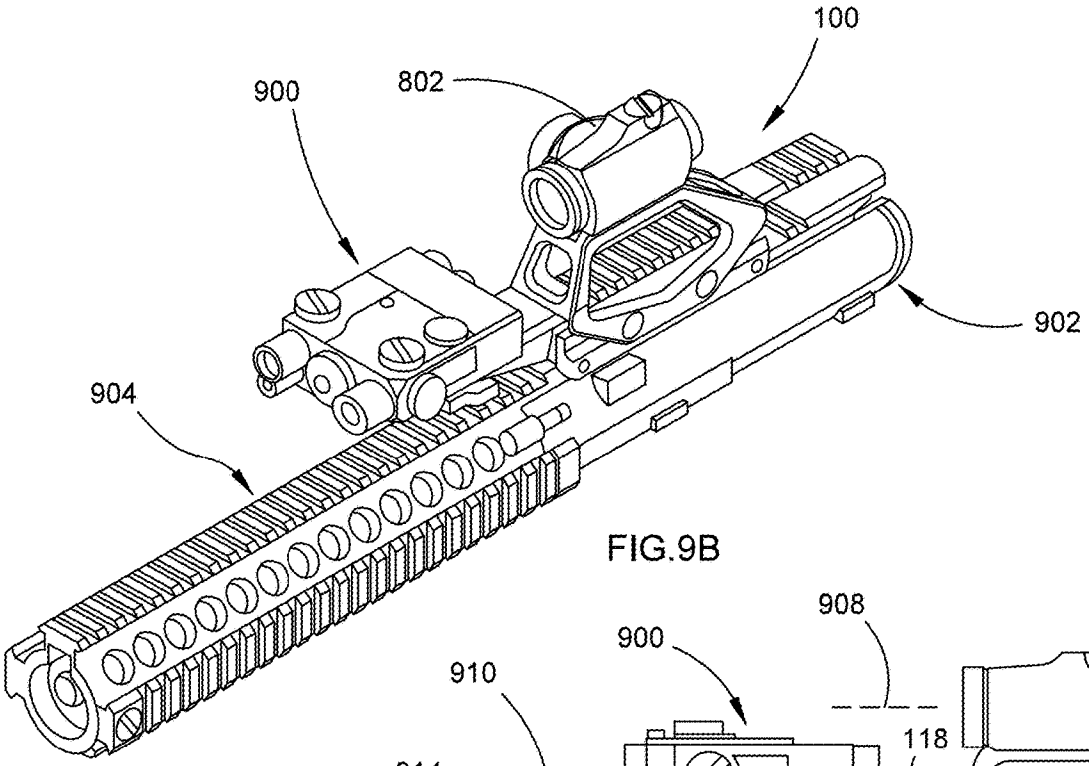
FIGS. 9A-9B show side and perspective views of the optics mount and riser system with the riser in place and a red dot sight mounted on top of the riser, in accordance with some embodiments.
Figure 9A:
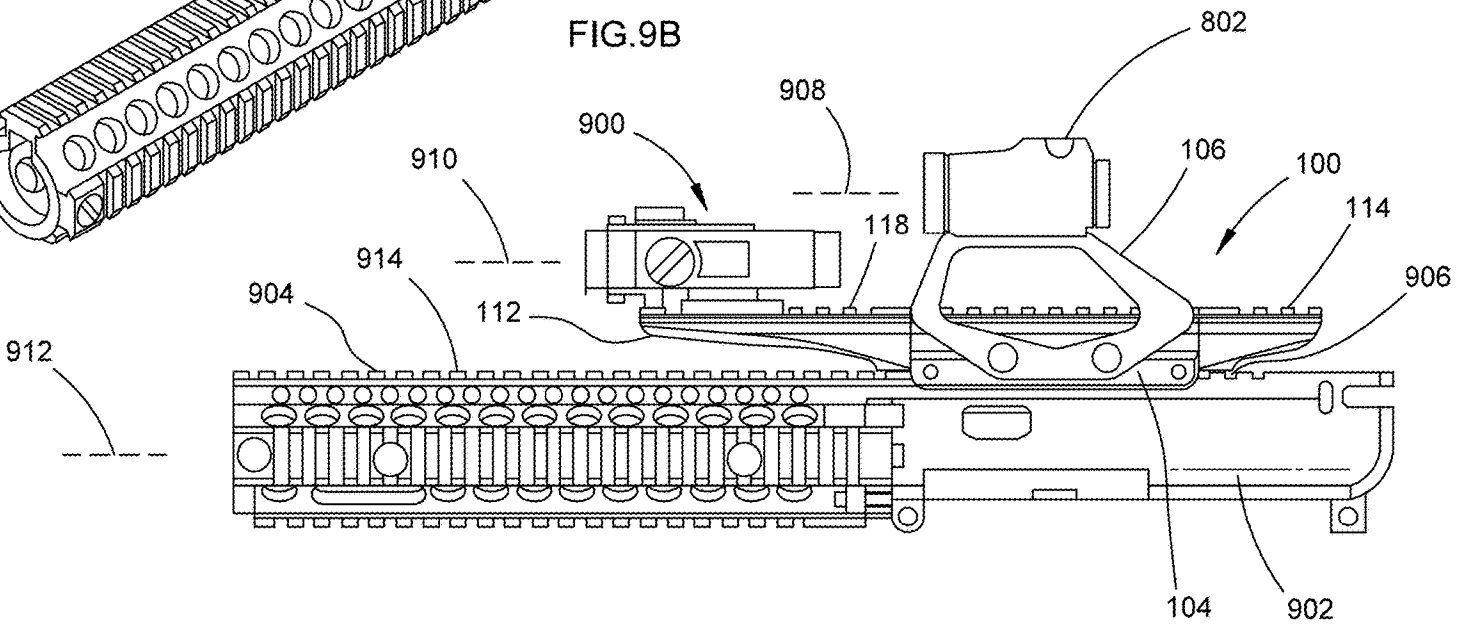

FIGS. 9A-9B show side and perspective views, respectively, of the optics mount and riser system 100 with the riser 106 in place on the rail 906 on the top of an upper receiver 902 of an AR-type rifle. There is a red dot sight 802 mounted on top of the riser 106. A dual beam aiming laser unit (DBAL) 900 is shown mounted on the rail 118 of the front rail extension portion 112 and the red dot sight 802 is mounted on the riser 106 to look over the DBAL unit 900. The handguard 904 extends from the front of receiver 902, and can provide a rail portion 914 that extends and is co-level with the rail 906 on the top of the receiver 902. The line of sight 908 of the red dot sight 802 is above the DBAL unit 900, and the DBAL unit 900 provides lasers along line 910, and the line of sight 908 and laser line 910 are both located above the bore axis 912 of the barrel (not shown here, but would be in the handguard 904). The operator and align the lines to meet at a point of impact of projectiles shot from the firearm at a given distance (e.g. zeroing).

Figure 10B:
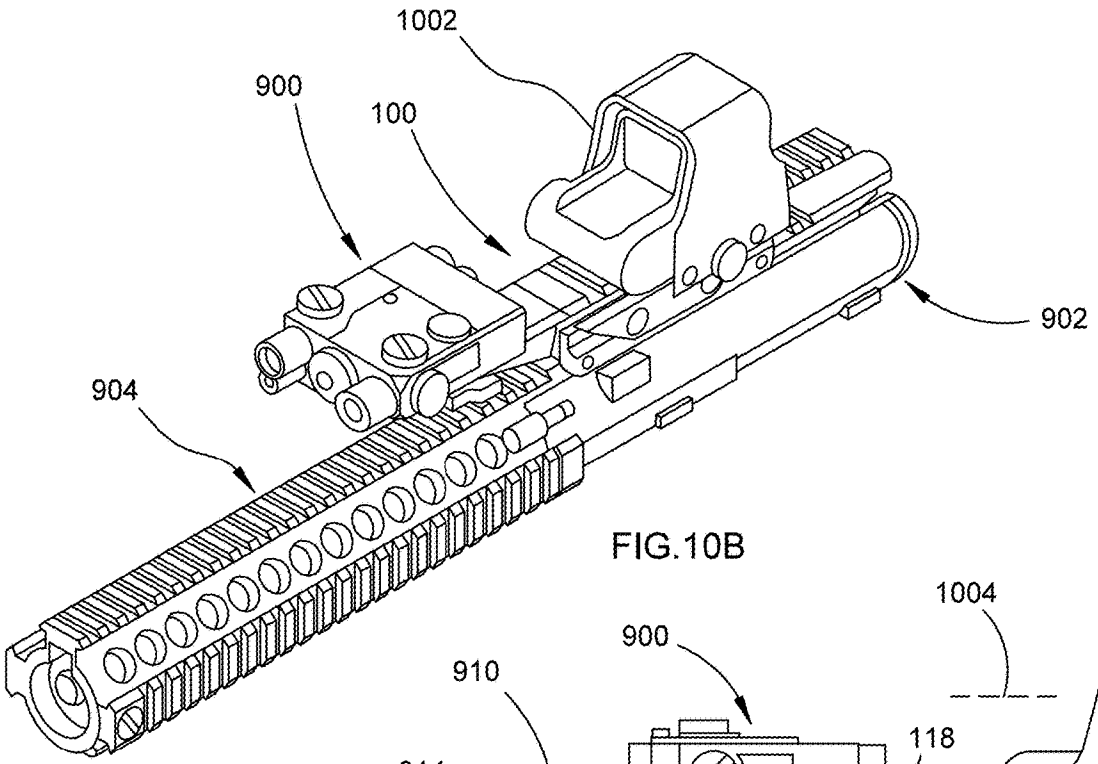
FIGS. 10A-10B show side and perspective views of the optics mount and riser system without the riser in place and a red dot sight mounted on top of the bridge portion directly, in accordance with some embodiments.
Figure 10A:
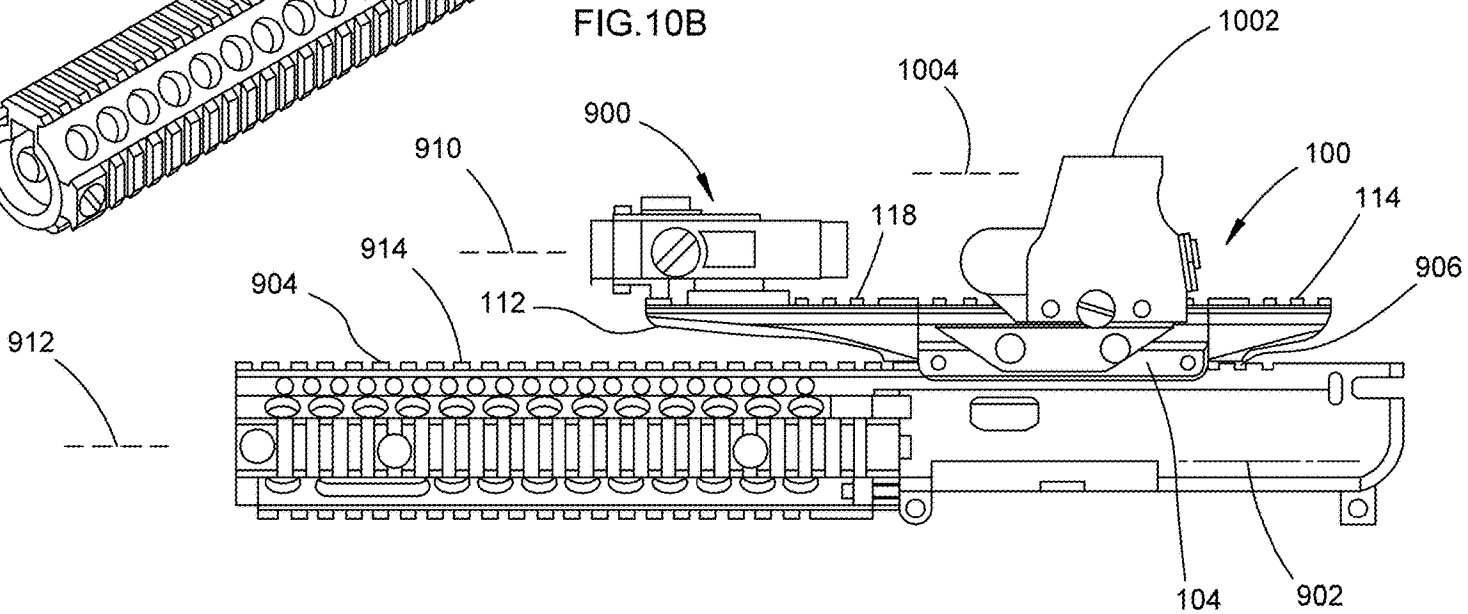

FIGS. 10A-10B show side and perspective views, respectively, of the optics mount and riser system 100 without the riser 100 in place and a different red dot sight 1002 mounted on top of the bridge portion 102 directly, and specifically on the rail 124 of the bridge portion 102. Here the red dot sight 1002 itself has the equivalent of its own riser and mounts directly onto the rail 124 of the bridge portion 102. The red dot sight here is elevated enough so that its line of sight 1004 is above the DBAL unit 900, and the DBAL unit 900 is not in the way of the sight 1002 such that it block the view through the sight 1002.

Figure 11:
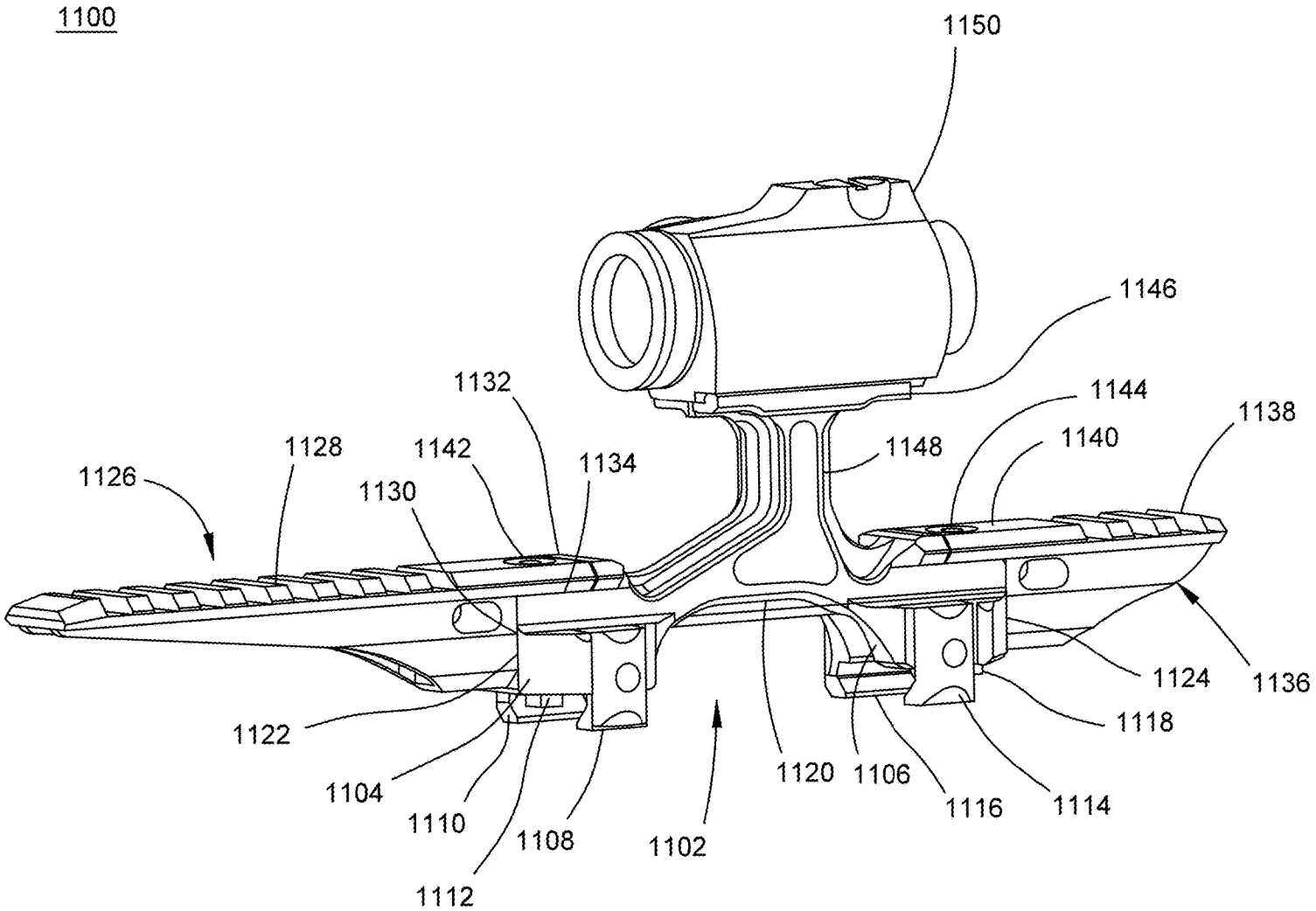
FIG. 11 shows a side perspective view of an optics mount and riser system including a riser in place with a red dot sight in place on top of the riser, in accordance with some embodiments.

FIG. 11 shows a side perspective view of an optics mount and riser system 1100 including a integral riser 1148 in place with a red dot sight 1150 in place on top 1146 of the riser. In the present embodiment the bridge portion 1102 has a forward or front rail clamp 1108 and a rear/rearward rail clamp 1114. The rail clamps 1108, 1114 each have a bolt or fastener to move clamp member 1108, 1114 into engagement with the side of a Picatinny rail on the top of a firearm. The clamp members 1108, 1114 tighten against the rail in a direction perpendicular to the elongated direction of the rifle (e.g. from buttstock to muzzle). To prevent clothing or other articles from snagging on the clamp members 1108, 1114 there are fender portions 1104, 1106 at the front side and rear side of each of the clamp member. The fender portions extends from the body of the bridge portion 1102 outward along an angle to define a recess in which the clamp members 1108, 1114 sit. Front clamp member 1108 opposes a similar fixed clamp portion 1110, and rear clamp member 1114 opposes fixed clamp portion 1116. One or more rail engagement protrusions 1112, 1118 extend downward from the bottom of the bridge portion 1102 to sit between raised portions of the rail on the top of the firearm and prevent movement forward or backward. The bridge section 1102 shown here has an integral riser 1148 that extends upward from a connecting portion 1120 that spans between the front and rear portions of the bridge portion. The front end 1122 of the bridge portion presents a vertical face that defines a plane that is perpendicular to a top surface 1134 of the front portion. Likewise, the rear end 1124 presents a vertical face.

Figure 12:
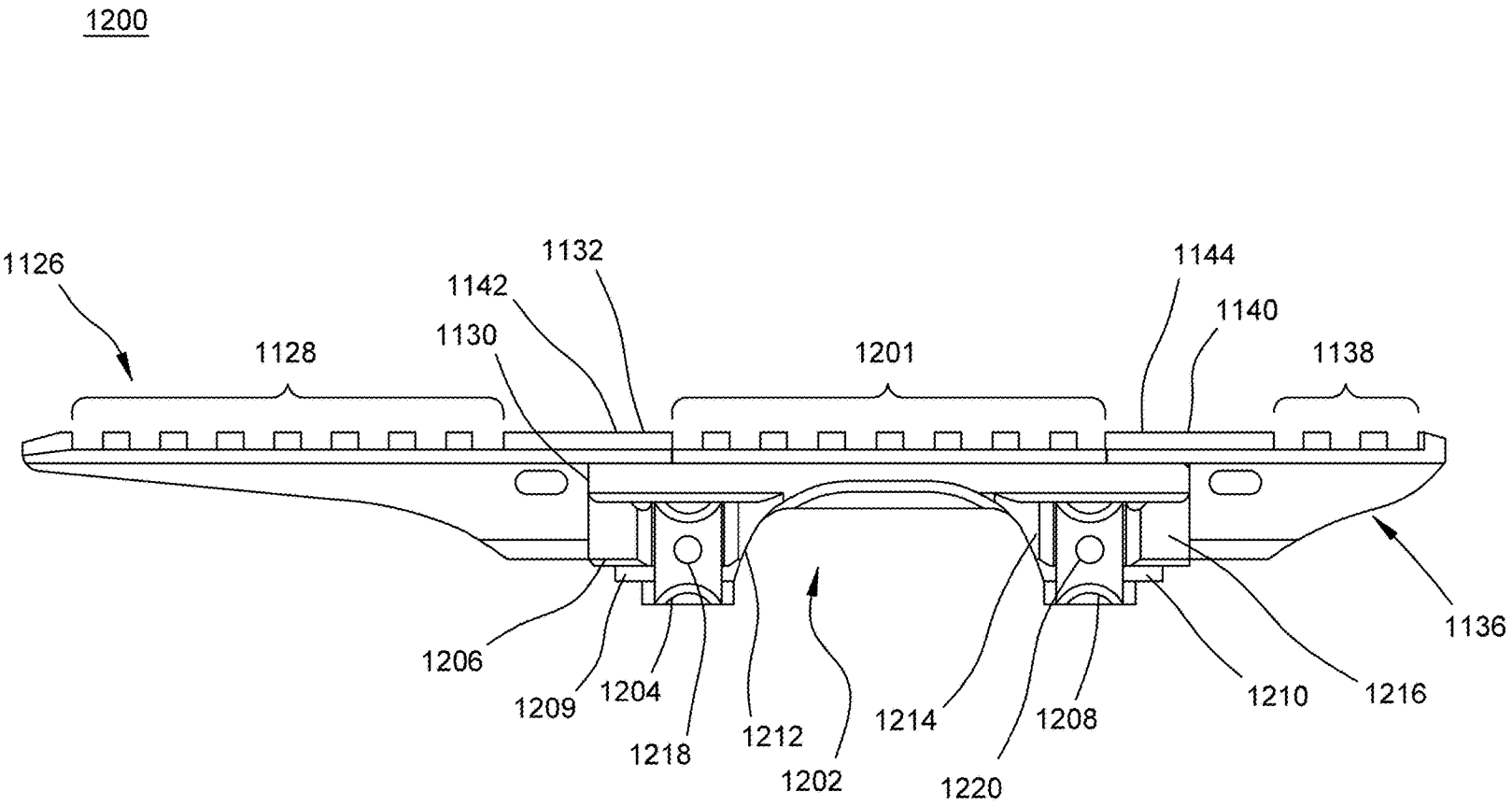
FIG. 12 shows a side elevational view of a riser system, in accordance with some embodiments.
Figure 13:
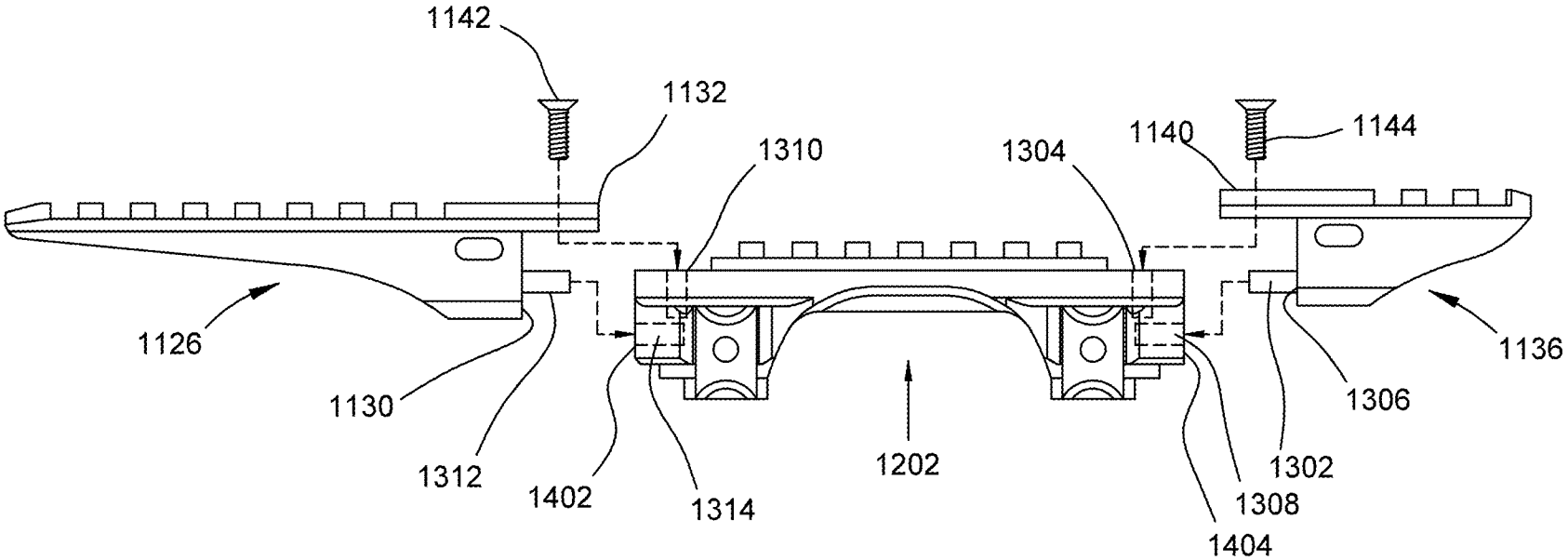
FIG. 13 shows a exploded view diagram from a side view of the riser system of FIG. 12, in accordance with some embodiments.

A front rail extension portion 1126 attaches to the front of the bridge portion 1102, and a rear rail extension portion 1136 attaches to the rear of the bridge portion 1102 as is shown in FIG. 13, which is shared by the embodiment of FIG. 12, which shows a bridge portion 1202 that lacks an integral riser 1148 and instead provides a top rail section 1201. The front rail extension portion 1126 and the rear rail extension portion 1136 do not attach to the rail of the firearm, and lack any features for doing so. Instead, the front rail portion has a face 1130 that mates to the front end 1402 of the bridge portion 1102, in which an alignment protrusion or pin 1312 extends, into a bore 1314 in the front end of the bridge portion. The bore 1314 is not threaded. The front rail extension portion 1126 includes a rail section 1128 on its top, and has a tongue 1132 that extends over the top 1134 of the front end of the bridge portion, and a screw fastener 1142 passes through an opening in the tongue 1132 and into a corresponding threaded bore in the top 1134 of the front end to secure the front rail extension portion 1126 to the front end of the bridge portion. Likewise, the rear rail extension portion 1136 includes a rail section 1138 that is co-level with the rail section 1128 of the front rail extension portion, and the top rail section 1201 of the bridge portion 1202 of FIG. 12. The rear rail extension portion 1136 has an alignment pin or protrusion 1302 at its front face 1306 that extends into a corresponding bore 1308 in the rear end of the bridge portion 1102, 1202. The rear rail extension portion 1136 has a tongue 1140 that will be against the top of the bridge portion at the rear end of the bridge portion, and a fastener 1144 passes through an opening in the tongue 1140 and into a threaded bore 1304 in the bridge portion. To assemble the front and/or rear rail extension portions, they must be oriented so that the alignment pin 1312, 1302 is horizontally aligned with their corresponding alignment bore 1314, 1308, respectively, with the tongue 1132, 1140 at the top. As the respective rail extension portion 1126, 1136 is placed at the front end or rear end, the tongue 1132, 1140 will slide over the top of the respective bridge portion end. Once the respective rail extension portion 1126, 1136 is that moved into full engagement with the bridge portion and the alignment pin 1312, 1302 is fully seated in their respective corresponding bore 1314, 1308, the opening in the tongue 1132, 1140 will be aligned with the corresponding fastener bore 1310, 1304, and the fastener 1142, 1144 can be threaded into engagement to secure the respective rail extension portion 1126, 1136 to the bridge portion 1102, 1202. Thus, each of the front and rear rail extension portions fasten to the bridge portion using a horizontally aligned alignment pin, a tongue that extends over the top of the bridge portion, and a vertically aligned fastener that passes through the tongue and threads into the bridge portion. Those skilled in the art will realize that the tongue can be formed on the bridge portion to pass over the top of the rail extension portion in an equivalent manner. However, putting the tongue on the rail extension portions ensures that the bridge portion is lighter. Furthermore, having the tongue extend from the bridge portion puts the tongue at risk of being broken off when there isn't a rail extension portion attached to the bridge portion at that end of the bridge portion.

Figure 14:
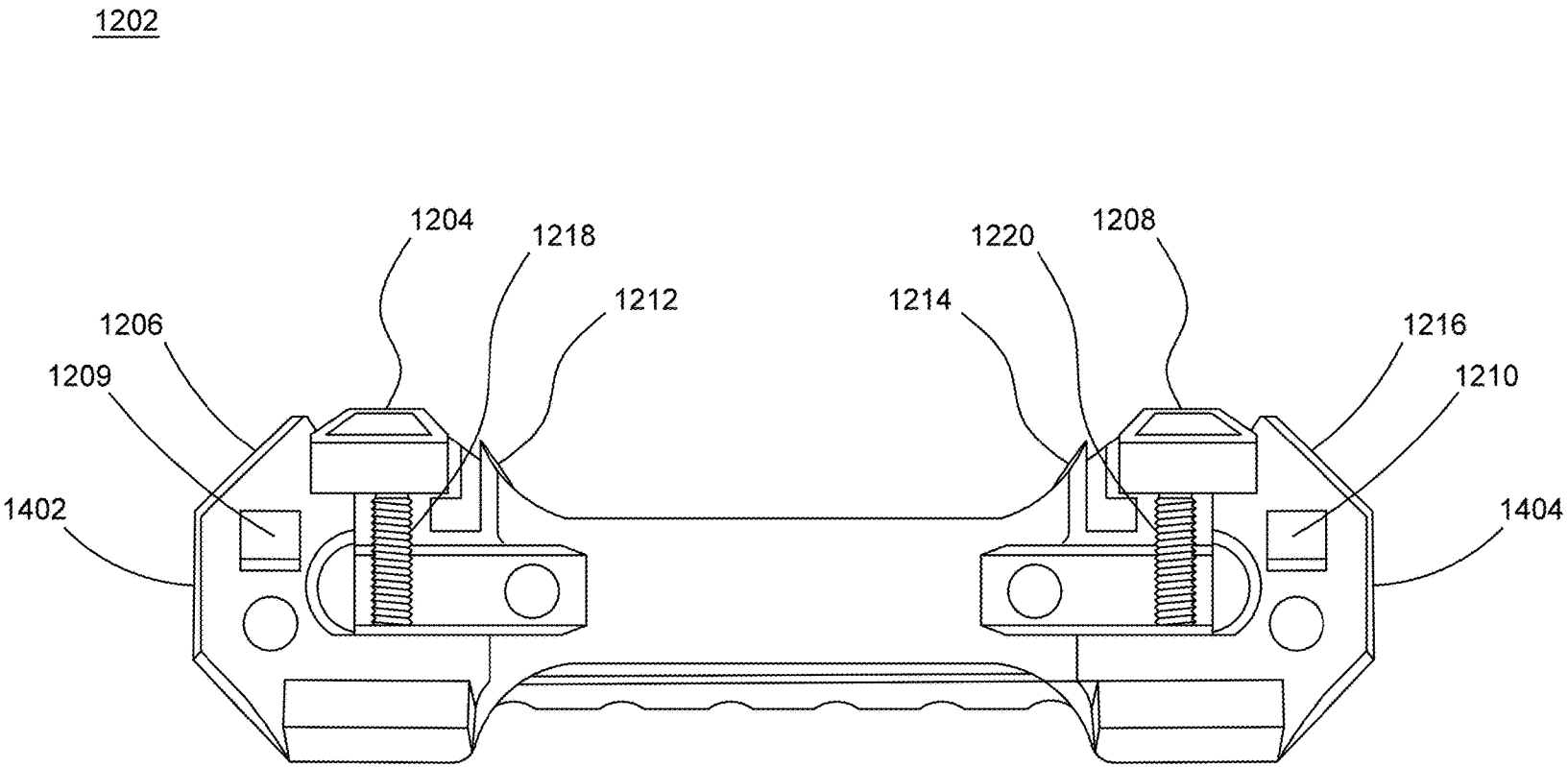
FIG. 14 shows a bottom view of the bridge portion shown in FIG. 13.

FIG. 12 shows a side elevational view of a riser system 1200 in which the bridge portion 1202 has a top rail section 1201 instead of an integral riser as in the embodiment of FIG. 11. In the embodiment shown here the front and rear rail extension portions 1126, 1136 are the same as that shown in FIGS. 11 and 13. FIG. 13 shows an exploded assembly view of the system 1200, and FIG. 14 shows a bottom view of the bridge portion 1202. Likewise, the front end 1402 and rear end 1402 of the bridge portion 1202 are the same as that shown in FIG. 11. The bridge portion 1202 includes the front and rear rail clamps 1204, 1208, and fender portions 1206, 1212, 1214, and 1216. However, instead of a riser stem to mount an optic, the bridge portion 1202 shown here simply has a rail section 1201 at the same level as the rail sections 1128, 1138 of the front and rear rail extension portions 1126, 1136. This shows how there can be a wide variety of designs of the bridge portion and all the designs can have substantially similar front end, rear end, and rail clamps in common so that they can all receive common rail extension portions that attach to the bridge portion. The clamp fasteners 1218, 1220, and rail engagement features 1209, 1210 sit between the raised rail segments of the rail on the top of the rifle receiver.

Figure 15A:
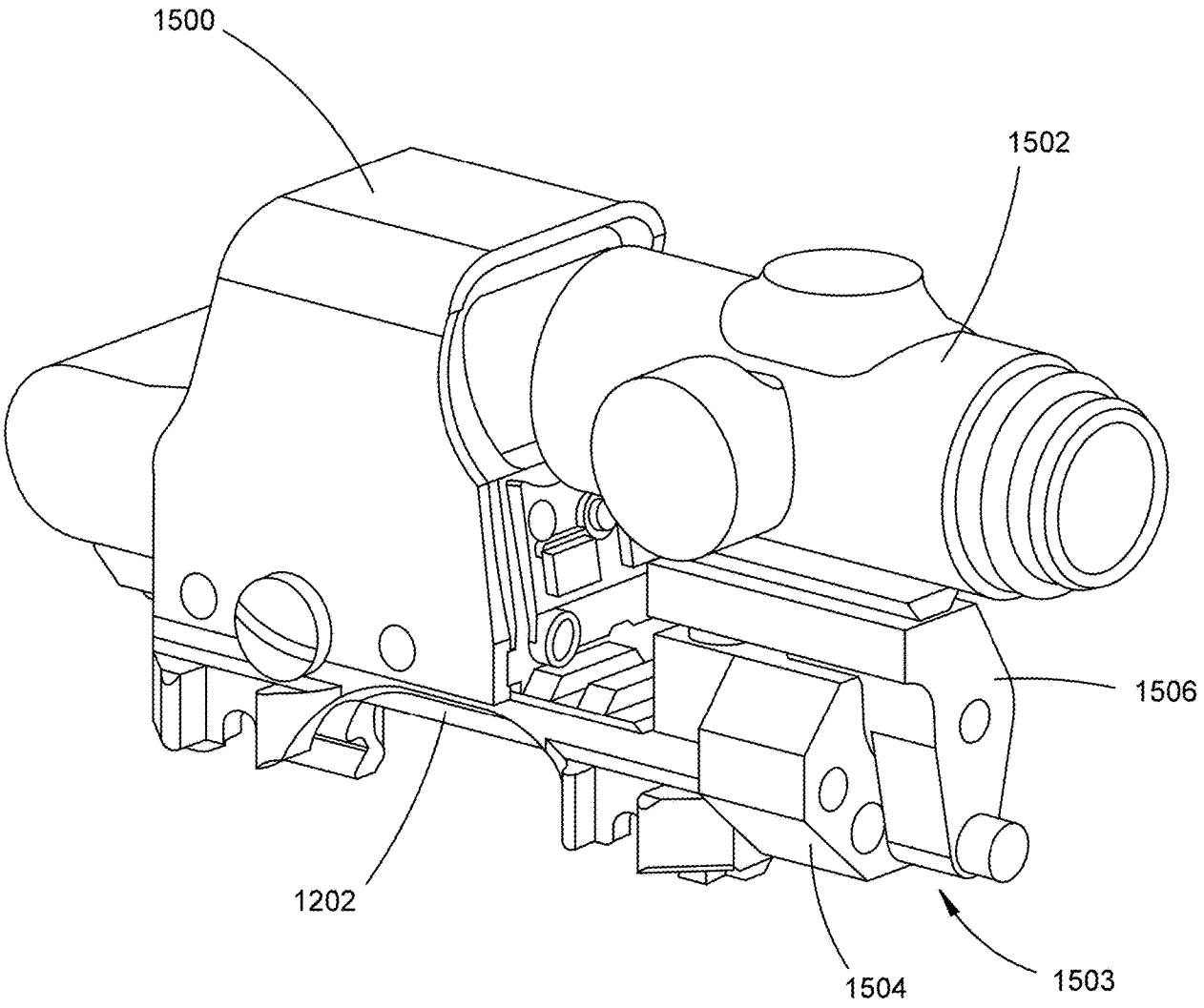
FIG. 15A shows a bridge portion with a red dot sight and magnifier mounted on the bridge portion and the magnifier aligned with the red dot sight.
Figure 15B:
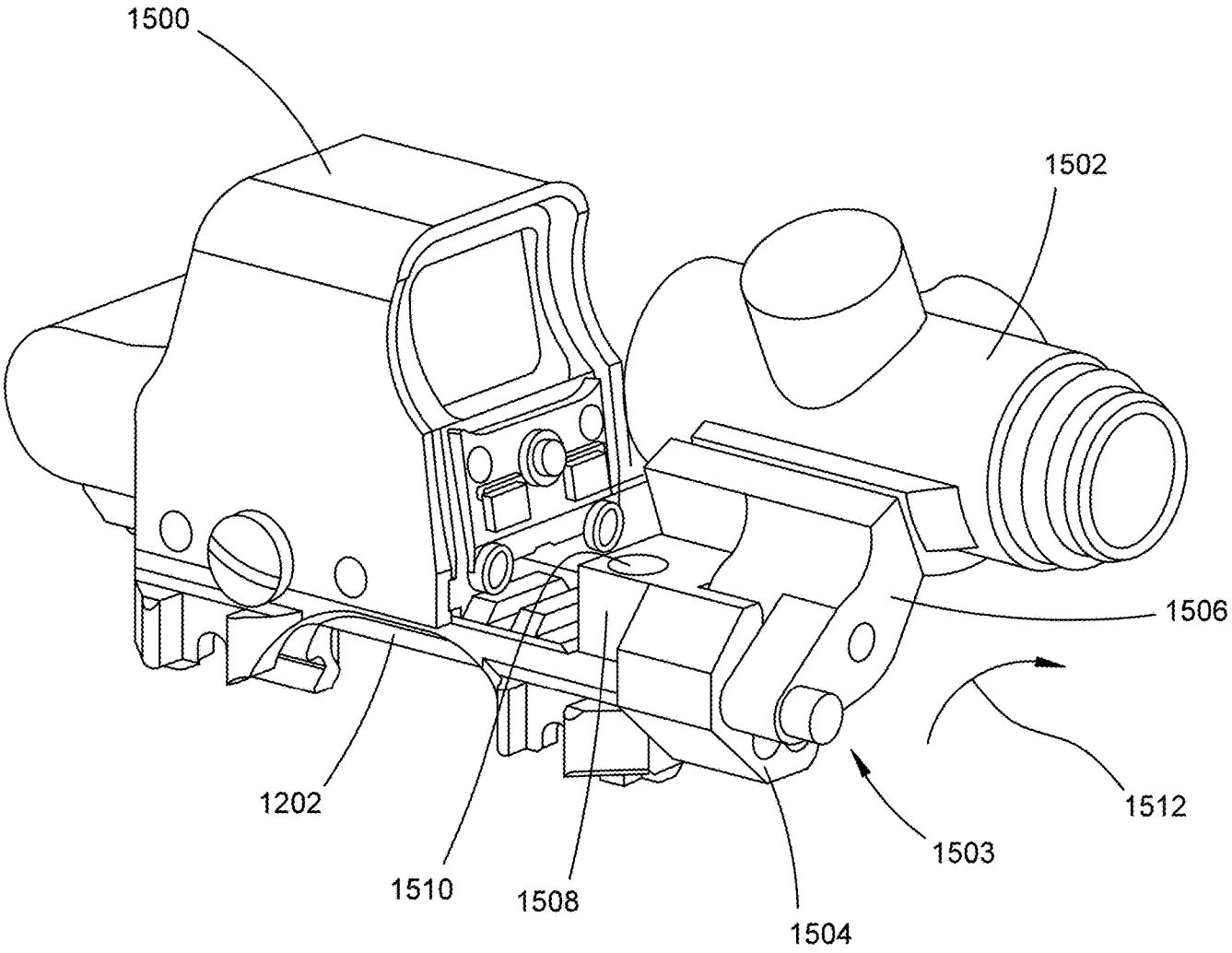
FIG. 15*b* shows a bridge portion with a red dot sight and magnifier mounted on the bridge portion and the magnifier flipped to the side.

FIG. 15A shows a bridge portion 1202 with a red dot sight 1500 and magnifier 1502 mounted on the bridge portion 1202 and the magnifier 1502 aligned with the red dot sight 1500. FIG. 15B shows the bridge portion 1202 with the red dot sight 1500 and magnifier 1502 mounted on the bridge portion 1202 and the magnifier 1502 flipped to the side. The magnifier is on a magnifier mount 1503 that mounts to the rear end of the bridge portion 1202 the same way as the rear rail extension portion 1126. An alignment pin or protrusion on a fixed portion 1504 of the magnifier mount 1503 is inserted into the horizontal bore 1308 at the vertical face of the rear end 1404 of the bridge portion 1202. A tongue 1508 of the fixed portion 1504 of the magnifier mount 1503 extends over the top of the rear end 1404 of the bridge portion 1202, and a threaded fastener 1510 extends through the tongue and into the threaded bore 1304 in the vertical direction. The magnifier 1502 is mounted on the top of the moveable portion 1506 of the magnifier mount 1503, which can be flipped to the side, as indicated by arrow 1512. Thus, if the operator wants a magnified view through the red dot sight 1500 the magnifier 1502 can be moved to the position shown in FIG. 15A. When the operator does not want a magnified view, the magnifier 1502 can be flipped to the side as in FIG. 15B.

Accordingly, and an optic mount modular system has been disclosed and includes a bridge portion that is mounted on the top rail of a firearm. The bridge portion can have either an integral optics riser on which a sight can be mounted, or a top rail section. The bridge portion has a front end and a rear end, each of which have a vertical face in which there is a horizontal bore. At the top of the bridge portion at the front and rear ends there are horizontal interfaces or surfaces in which there are vertically oriented threaded bores. Accessories such as rail extension portions and magnifier mounts can be mounted to the bridge portion at the front and rear ends. These accessories can include an alignment pin or protrusion than extends from a vertical face that mates against the vertical face at the front end or rear end of the bridge portion, and the alignment pin or protrusion will fit into the horizontal bore of the front or rear end. The accessories also have a tongue that extends over the top of the bridge portion at the front end or rear end, and a threaded fastener passes through an opening in the tongue that is aligned with the vertical threaded bore in the bridge portion. A threaded fastener can then securely attach the accessory to the bridge portion.

What is claimed is:

1. An optics riser for a firearm, the firearm having a rail on a top of the firearm, comprising:

a bridge portion having a front end and a rear end, the bridge portion having a top surface adjacent the front end and a top surface adjacent the rear end;

at least one clamp that is configured to clamp the bridge portion to the rail of the firearm, the clamp having a first clamp member at a first side of the bridge portion and a second clamp member at a second side of the bridge portion opposing the first clamp member; and at at least one of the front end or the rear end there is a vertical face into which is formed a horizontal bore, the horizontal bore being positioned beneath the top surface and along a longitudinal axis from the front end to the rear end and between the first side of the bridge portion and the second side of the bridge portion.

2. The optics riser of claim 1, wherein a top of the bridge portion includes a rail section.

3. The optics riser of claim 1, wherein a top of the bridge portion includes an integral riser stem having a top.

4. The optics riser of claim 3, wherein the top of the riser stem includes an optics bed.

5. The optics riser of claim 1, wherein the at least one clamp member comprises a front clamp member and a rear clamp member.

6. A riser system for mounting on a top rail of a firearm, comprising:

a bridge portion having a front end and a rear end, and a top;

the front end having a vertical face defining a plane that is perpendicular to an elongated direction of the bridge portion, and into which a horizontal bore extends, the bore being positioned into the front face below the top of the bridge portion at the front end of the bridge portion and along a longitudinal axis from the front end to the rear end and that is between a first side of the bridge portion and a second side of the bridge portion;

at least one clamp that is configured to clamp the bridge portion to the rail of the firearm; and an accessory that mounts to the front end using an alignment pin that fits into the horizontal bore, and which is not attached to the rail of the firearm.

7. The riser system of claim 6, wherein the top of the bridge portion comprises a riser stem that extends vertically upward from the top of the bridge portion.

8. The riser system of claim 7, wherein a top of the riser stem comprises an optics bed.

9. The riser system of claim 6, wherein the top of the bridge portion comprises a rail section.

10. The riser system of claim 9, wherein the accessory is a rail extension portion and a top of the accessory comprises a rail section that is co-level with the rail section of the bridge portion.

11. The riser system of claim 6, wherein the vertical face of the front end further includes a threaded bore, and the accessory further includes a threaded fastener that passes through an opening in the accessory and into the threaded bore.

12. The riser system of claim 6, wherein the top of the bridge portion at the front end has a vertical bore that is threaded into the bridge portion, and the accessory includes a tongue that extends over the top of the bridge portion at front end of the bridge portion, the tongue having an opening through it that corresponds to the vertical bore, and a threaded fastener passing through the opening in the tongue and into the vertical bore.

13. The riser system of claim 12, wherein the top of the bridge portion includes a rail section, and top of the accessory includes a rail portion that is co-level with the rail second on the top of the bridge portion.

14. The riser system of claim 6, wherein the at least one clamp member comprises a front clamp member and a rear clamp member.

15. A riser for attaching to a rail on a top of a firearm, comprising:

a base having a front end and a rear end, a first side and a second side;

at least one clamp configured to clamp the base to the rail of the firearm, the at least one clamp including a first clamp member at the first side of the base and a second clamp member opposing the first clamp member at the second side of the base; and a horizontal bore formed into the front end of the base, between the first side of the base and the second side of the base, along a longitudinal axis from the front end to the rear end and below a top of the front end.

16. The riser of claim 15, further comprising a horizontal bore formed into the rear end of the base, between the first side of the base and the second side of the base, along the longitudinal axis and below a top of the rear end.

17. The riser of claim 16, further comprising a rear rail extension portion having a member that extends from the rear rail portion at a front of the rear rail portion and is configured to fit into the bore at rear end of the base.

18. The riser of claim 15, wherein the bore formed into the front end of the base is threaded.

19. The riser of claim 15, further comprising a vertical bore adjacent the top of the front end.

20. The riser of claim 15, further comprising a front rail extension portion having a member that extends from the front rail portion at a rear of the front rail portion and is configured to fit into the bore at front end of the base.

* * * * *